US006491878B1

(12) United States Patent
Locker et al.

(10) Patent No.: US 6,491,878 B1
(45) **Date of Patent: *Dec. 10, 2002**

(54) CATALYTIC CONVERTER FOR USE IN AN INTERNAL COMBUSTION ENGINE

(75) Inventors: Robert J. Locker, Corning, NY (US); Paul S. Schmitt, Big Flats, NY (US)

(73) Assignee: Corning Incorporated, Corning, NY (US)

( * ) Notice: Subject to any disclaimer, the term of this patent is extended or adjusted under 35 U.S.C. 154(b) by 41 days.

This patent is subject to a terminal disclaimer.

(21) Appl. No.: 09/685,535

(22) Filed: Oct. 10, 2000

Related U.S. Application Data

(62) Division of application No. 09/013,986, filed on Jan. 27, 1998, now abandoned.

(60) Provisional application No. 60/037,978, filed on Feb. 12, 1997.

(51) Int. Cl.[7] ..... F01N 3/28; B01D 53/88; B01D 53/94

(52) U.S. Cl. ..... 422/179; 422/171; 422/177; 422/180

(58) Field of Search ..... 422/171, 179, 422/180, 221, 177

(56) References Cited

U.S. PATENT DOCUMENTS

| | | | | |
|---|---|---|---|---|
| RE27,747 E | | 9/1973 | Johnson | 165/166 |
| 3,958,312 A | | 5/1976 | Weaving et al. | 29/890 |
| 4,239,733 A | | 12/1980 | Foster et al. | 422/179 |
| 4,750,251 A | | 6/1988 | Motley et al. | 422/179 |
| 4,782,661 A | | 11/1988 | Motley et al. | 422/180 |
| 4,925,634 A | | 5/1990 | Yokokoji et al. | 422/179 |
| 4,985,212 A | | 1/1991 | Kawakami et al. | 422/179 |
| 5,273,724 A | | 12/1993 | Bos | 422/179 |
| 5,293,743 A | * | 3/1994 | Usleman et al. | 422/179 |
| 5,376,341 A | | 12/1994 | Gulati | 422/179 |
| 5,724,735 A | * | 3/1998 | Ickes et al. | 29/515 |
| 5,787,584 A | * | 8/1998 | Shea et al. | 422/180 |
| 6,299,843 B1 | * | 10/2001 | Locker et al. | 29/890 |

FOREIGN PATENT DOCUMENTS

| | | | |
|---|---|---|---|
| DE | 2746475 | | 4/1979 |
| DE | 8715289 | | 1/1988 |
| EP | 639700 | * | 2/1995 |
| EP | 0 643 204 A2 | | 3/1995 |
| EP | 768451 | * | 4/1997 |
| FR | 2224639 | | 10/1974 |
| JP | 58032917 | | 2/1983 |

* cited by examiner

*Primary Examiner*—Hien Tran
(74) *Attorney, Agent, or Firm*—Kees van der Sterre; Timothy M. Schaeberle

(57) ABSTRACT

A catalytic converter for purifying exhaust gases from an internal combustion engine includes a monolithic ceramic substrate having a peripheral surface encircled by a non-intumescent supporting mat material. A metal shell comprising a wider portion which is adjacent to and encloses the mat material and the substrate. The metal shell further comprises a narrower portion which overlaps and is attached to the outer surface of the wider metal shell portion. The wider and narrower metal shell portions combine to exert a compressive force on the wrapped substrate.

3 Claims, 5 Drawing Sheets

CATALYTIC CONVERTER FOR USE IN AN INTERNAL COMBUSTION ENGINE

This application is a division of U.S. application Ser. No. 09/013,986 filed Jan. 27, 1998 now abandoned, which claims the benefit of U.S. Provisional Application No. 60/037,978, filed Feb. 12, 1997 entitled Method of Making a Catalytic Converter for Use in an Internal Combustion Engine by Robert J. Locker and Paul S. Schmitt.

BACKGROUND OF THE INVENTION

1. Field of the Invention

The invention relates to catalytic converters for purifying exhaust gases, and more particularly to catalytic converters for purifying exhaust gases from a motorcycle internal combustion engine.

2. Description of the Related Art

Automobile and motorcycle exhaust gases are conventionally purified with a catalyst supported on a ceramic body able to withstand high temperatures. The preferred catalyst support structure is a honeycomb configuration which includes a multiplicity of unobstructed parallel channels sized to permit gas flow and bounded by thin ceramic walls. The channels may have any configuration an:d dimensions provided gases can freely pass through them without being plugged by entrained particulate material. Examples of such preferred structures included the thin-walled ceramic honeycomb structures described in U.S. Pat. No. 3,790,654 to Bagley and in U.S. Pat. No. 3,112,184 to Hollenbach.

Ceramic honeycomb catalyst supports are exposed to high temperatures resulting from contact with hot exhaust gases and from the catalytic oxidation of uncombusted hydrocarbons and carbon monoxide contained in the exhaust gas. In addition, such supports must withstand rapid temperature increases and decreases when the automobile engine is started and stopped or cycled between idle and wide-open throttle. Such operating conditions require the ceramic honeycomb catalyst support to have a high thermal shock resistance, a property generally inversely proportional to the coefficient of thermal expansion.

Ceramic supports for catalytic converters are typically formed from brittle, fireproof materials such as aluminum oxide, silicon oxide, magnesium oxide, zirconium silicate, cordierite, or silicon carbide. The typical honeycomb configuration of supports made from these ceramic materials enables even very small mechanical stresses to cause cracking or crushing. In view of their brittleness, a great effort has been expended to develop catalytic converter housings, or cans, for such supports.

For example, U.S. Pat. No. 4,863,700 to Ten Eyck discloses a catalytic converter system where a frangible ceramic monolith catalyst is resiliently mounted in a metallic housing by an insulating layer of ceramic fibers wrapped around the monolith, and a layer of intumescent material disposed between the metal housing and the ceramic fiber layer.

In many applications, particularly those involving small motorcycle engines, there is little room for mounting catalytic converters. One such solution to this problem is to mount catalytic converter within existing exhaust system components rather than providing an additional catalytic converter housing; one such location being within a hot gas chamber which includes the expansion chambers and mufflers.

A complication of locating the converter inside the muffler housing is that the converter inside the muffler is not allowed cool efficiently enough to maintain standard intumescent mats within a favorable thermal environment (<550° C.); specifically, encapsulation within an insulated hot gas chamber such as a muffler prevents such converters from efficiently dissipating heat to the atmosphere. Furthermore, in such applications, the hot exhaust gas not only flows through the catalytic converters, but also around its housing. Consequently, in such applications the temperature of the catalytic converter housing assembly (i.e. the housing which maintains the converter in its correct position inside the hot gas chamber) commonly approaches 900° C. Furthermore, significant concentrations of gaseous raw fuel and oil typically appear in the exhaust gas stream, with the fuel-rich exhaust producing extreme exotherms within the converter resulting in temperatures as high 1100° C. Standard vermiculite based intumescent mats typically loose their ability to expand if exposed to temperatures greater that ~750° C. Specifically, intumescent mats loses their chemically-bound water when exposed to such high temperature. The loss of chemically-bound water damages the intumescent character of the material so that it does not provide adequate mounting pressure to retain the ceramic catalyst support. This jeopardizes the ability of the ceramic catalyst to withstand axial and other forces resulting from exhaust gas flow and vehicle vibration. Intumescent mats, therefore, do not offer a viable option for internally mounted motorcycle converters.

Ceramic fiber mats, capable of exposure to temperatures as high as ~1200° C., represent an alternative to intumescents. The force generated by these mats is developed completely from the compression it undergoes during the canning of the catalytic converter. As such, the form of canning is critical to these fiber-based mats.

Stuff mounting is one method of canning which has been utilized in the past. Initially, the substrate is wrapped with the mat and inserted into a conical device which compresses the mat as it is pushed through. The wrapped substrate is then ejected from the compression cone into a cylindrical tube that serves as the converter shell. In the process of performing this activity, the mat must be maintained within a very narrow dimensional gap between the can and the substrate to be effective; acceptable fiber-based mat gap bulk density (GBD) is typically 0.55±0.05 g/cc. Problems inherent in the stuff mounting method include: (1) a gap which is too large, resulting in insufficient gripping pressure of the substrate and typically slipping of the wrapped substrate during vehicle operation; and (2) an overcompressed mat, resulting in damage to the mat, and ultimately leading to gas erosion.

Additional problems associated with stuff mounting include: (1) variability in the mat basis weight is 10% which alone results in some so-formed converters falling outside of the aforementioned acceptable GBD range; (2) substrate diameter variability; and, (3) variability in the metal shell tube diameter, into which the mat/substrate is placed. Even if the tolerance stack-up issues could be tolerated, stuff mounting these fiber based mats, at such high gap bulk densities, is an inefficient process, at best. The mat must be so "overcompressed", in the stuffing cone, prior to being injected into the finished tube, such that some of its 2-dimensional resiliency is lost (due to fiber damage). Furthermore, it has been observed that shear forces acting on the mat has caused some portions between the substrate and the shell to "leak" out of the gap at the top of the stuff mounted part. This loss of some of the mat from the gap, in turn has resulted in lower than desirable compressive forces holding the substrate in place.

As such, there continues to be a need for a catalytic converter which will remain securely mounted inside a hot gas chamber even at operating temperatures exceeding 800° C.

SUMMARY OF THE INVENTION

The present invention relates to a catalytic converter for purifying exhaust gases from an internal combustion engine. The converter includes a monolithic ceramic substrate having a peripheral surface encircled by a non-intumescent supporting mat material. A metal shell comprising a wider portion which is adjacent to and encloses the mat material and the substrate. The metal shell further comprises a narrower portion which overlaps and is attached to the outer surface of the wider metal shell portion. The wider and narrower metal shell portions combine to exert a compressive force on the wrapped substrate.

The present invention also relates to a method which overcomes the problems and shortcomings inherent in current methods of forming motorcycle catalytic converters, i.e., stuff mounting. In general, the method of manufacturing these catalytic converters first involves wrapping a monolithic ceramic substrate in a non-intumescent supporting mat material. The wrapped substrate is thereafter inserted into a metal shell which substantially conforms to the wrapped substrate, the metal shell comprising a wider encircling portion and a narrower extending attachment portion. The metal shell is then compressively closed around the substrate so that the wider metal shell portion is adjacent to and encloses the mat material and the substrate and the narrower portion overlaps the outer surface of the wider metal shell portion. Lastly, the inner surface of the narrower overlapped metal shell portion is secured to the outer surface of the wider metal shell portion to hold the compressive stress.

DETAILED DESCRIPTION OF THE INVENTION

Figure 1B:
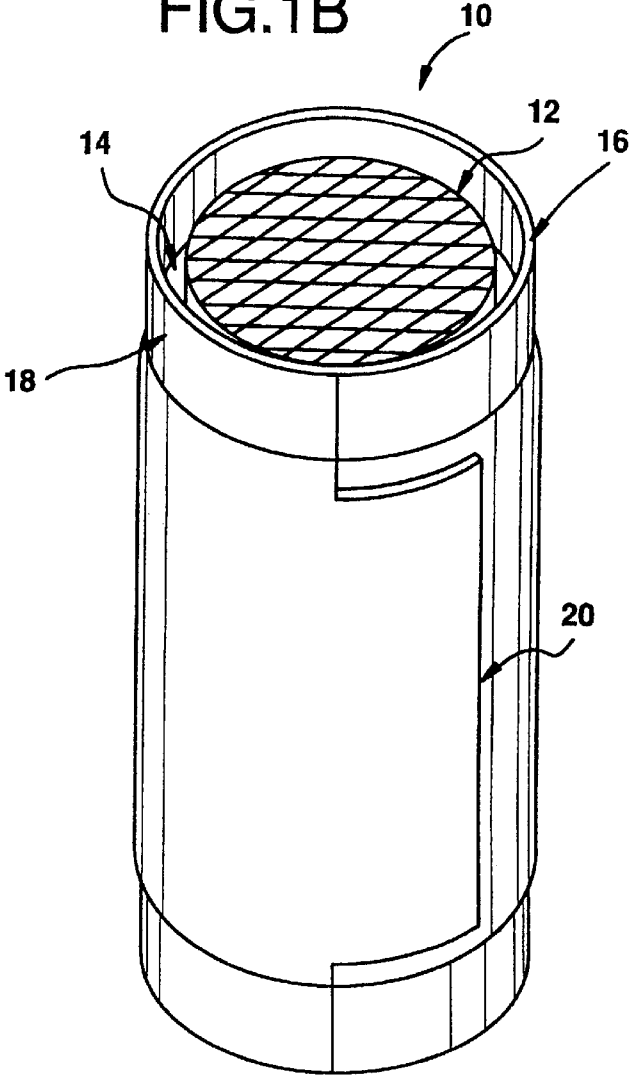
FIGS. 1A and 1B are perspective views of one embodiment of the inventive catalytic converter apparatus, unclosed and closed, respectively, in accordance with the present invention.
Figure 1A:
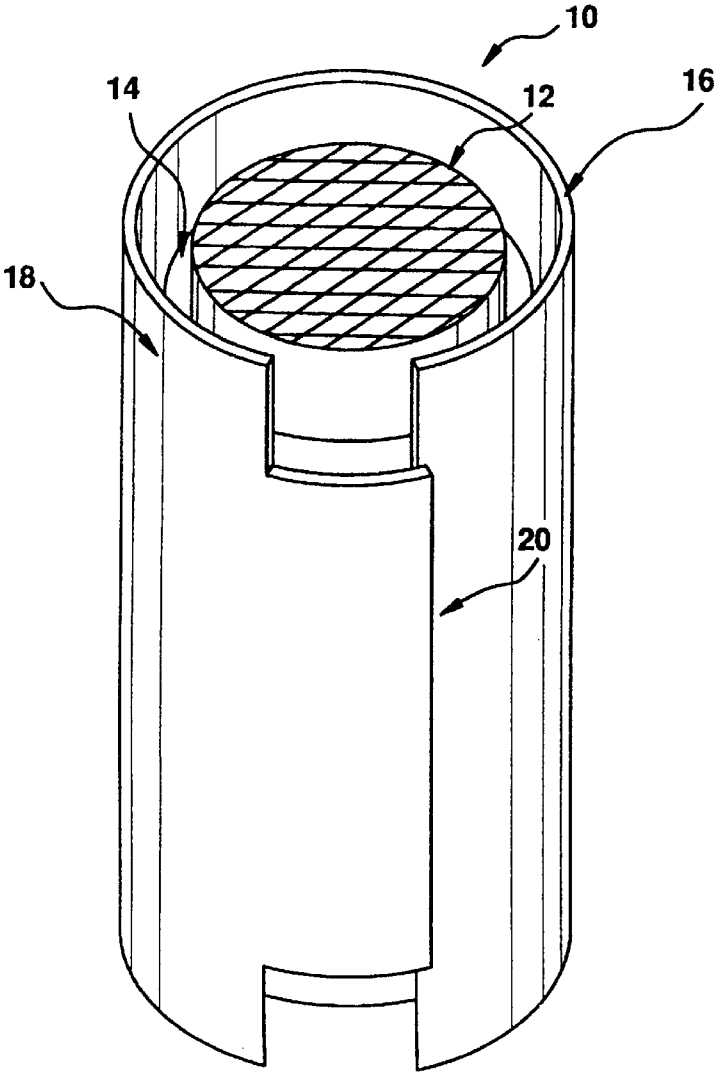

FIGS. 1A and 1B, illustrate two perspective views of the inventive catalytic converter 10 for purifying exhaust gases from an internal combustion engine, in accordance with the present invention; 1A representing an unclosed converter and 1B a finished closed converter. The method for forming the converter 10 is hereinafter described. Firstly, a monolithic ceramic substrate 12 is wrapped in a non-intumescent supporting mat material 14. Thereafter, wrapped substrate 12 is inserted into a metal shell 16 which substantially conforms to wrapped substrate 12. Specifically, metal shell 16 comprises a wider encircling portion 18 and narrower attaching portion 20. Metal shell 16 is compressively closed around substrate 12 whereby wider metal shell portion 18 is adjacent to and encloses mat material 14 and substrate 12. Narrower portion 20 overlaps the outer surface of the wider metal shell portion 18.

A tourniquet wrap method of canning is suitable for compressively closing the catalytic converter. In brief, the metal shell of the converter is wrapped in a metallic casing which surrounds the periphery of the metal shell 16. The metallic casing includes opposing straps which are pulled in opposite directions to compressively close the metal shell 16 around mat material 14 and substrate 12 to a desired target mat compression.

Once the shell is compressively closed around mat material 14 and substrate 12 the inner surface of narrower metal shell portion 20 is secured to the outer surface of wider metal shell portion 18 to hold the compressive stress. An acceptable method of securing involves welding the narrower portion to the wider portion.

Still referring to FIGS. 1A and 1B the so-formed catalytic converter 10 includes a monolithic ceramic substrate 12 having a peripheral surface encircled by a non-intumescent supporting mat material 14. A metal shell 16 comprising a wider encircling metal shell portion 18 and a narrower extending attachment metal shell portion 20, encloses mat material 14 and substrate 12. Specifically, wider encircling metal shell portion 18 is adjacent to and encloses substrate 12 and mat material 14 while narrower extending metal shell portion 20 overlaps and is attached to the outer surface of wider metal shell portion 18. The metal shell portions combining to exert compressive force on the wrapped substrate.

In one embodiment of the invention wider metal shell portion 18 exhibits a width which is equal to or greater than length of the substrate 12. Additionally, mat material 14 exhibits a length whereby a portion of substrate 14 peripheral surface at each end is uncovered.

This tourniquet wrap forming technique and the so-formed catalytic converter provides a number of advantages over the stuff mounted catalytic converters. Tourniquet wrapping catalytic converters to calibrated force compensates for non-uniformities in the mat basis weight as well as variability in the substrate diameter.

Figure 2:
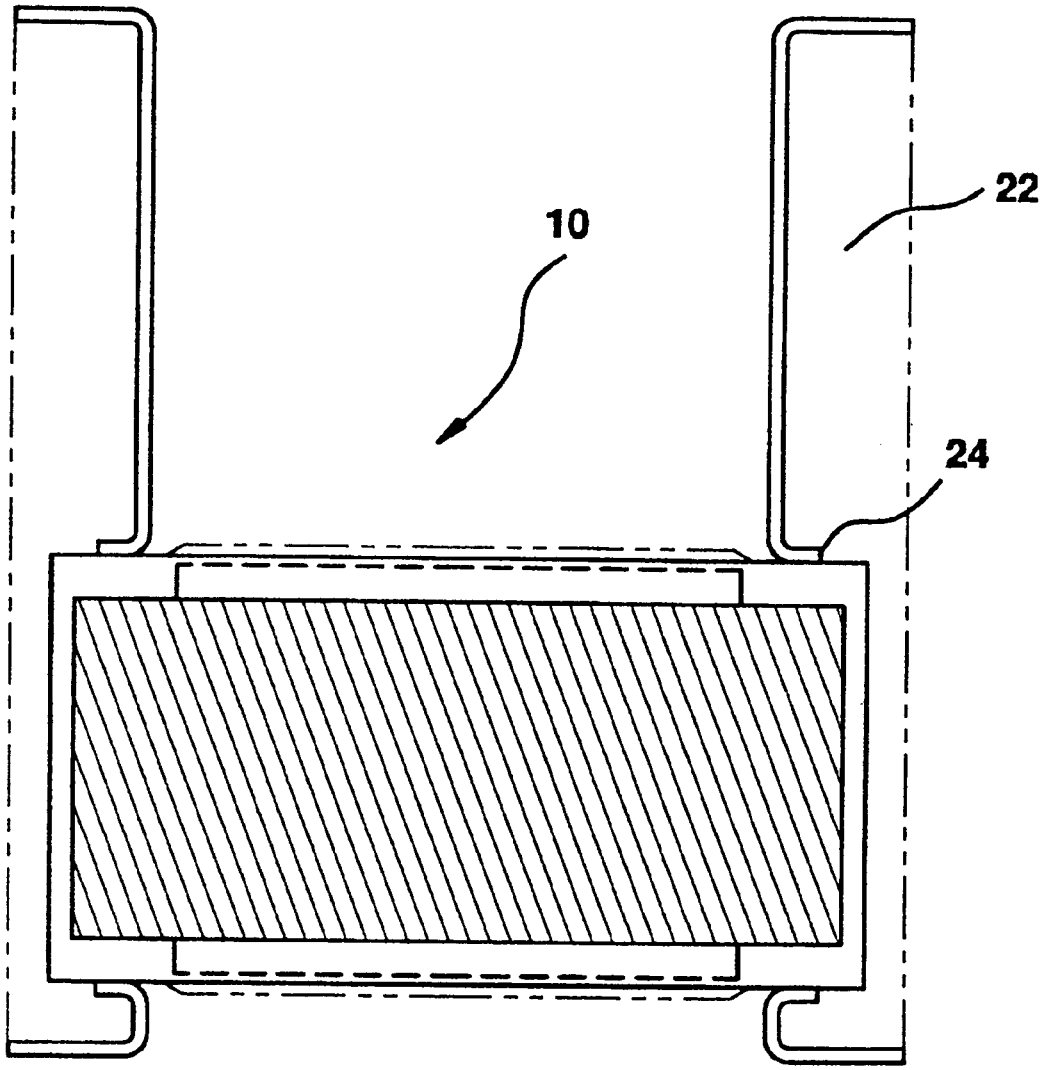
FIG. 2 is a cross-sectional view of this catalytic converter as disposed in a hot gas chamber.

FIG. 2 illustrates a portion of a hot gas chamber 22 having a catalytic converter inserted therein. Conventional hot gas chambers include expansion chambers and mufflers in which an exhaust pipe empties into a chamber housing with a larger cross-sectional area than the exhaust pipe. The larger cross-sectional area allows the hot exhaust gases to expand and provides an area in which noise may be muffled. The aforementioned process of tourniquet wrapping substrates to a calibrated force results in converters with cans of varying OD, therefore resizing of the converter ends is necessary to provide a consistent product diameter capable of being inserted into the hot gas chamber at position 24 which is preset prior to insertion of the converter.

Figure 3A:
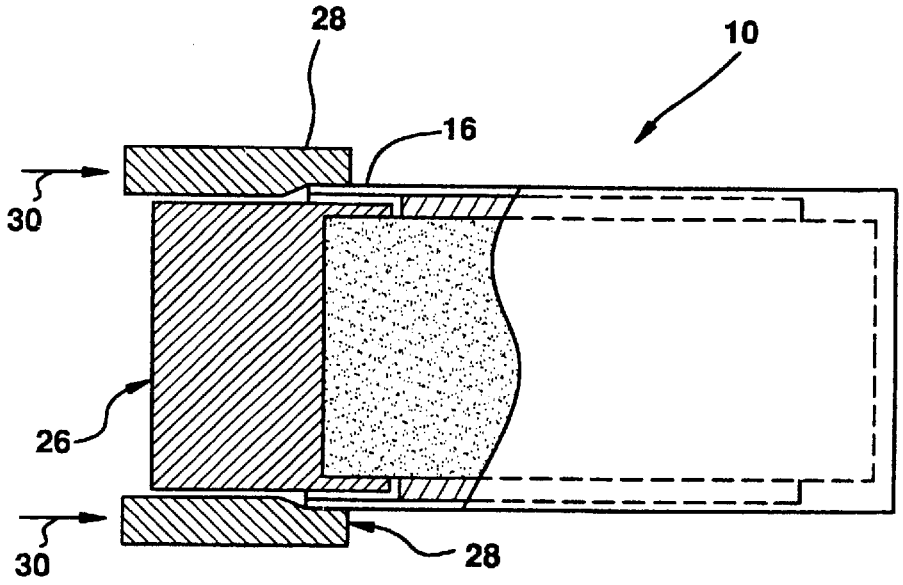
FIGS. 3A and 3B are side cross-sectional views of method of resizing the catalytic converter, in accordance with the present invention.
Figure 3B:
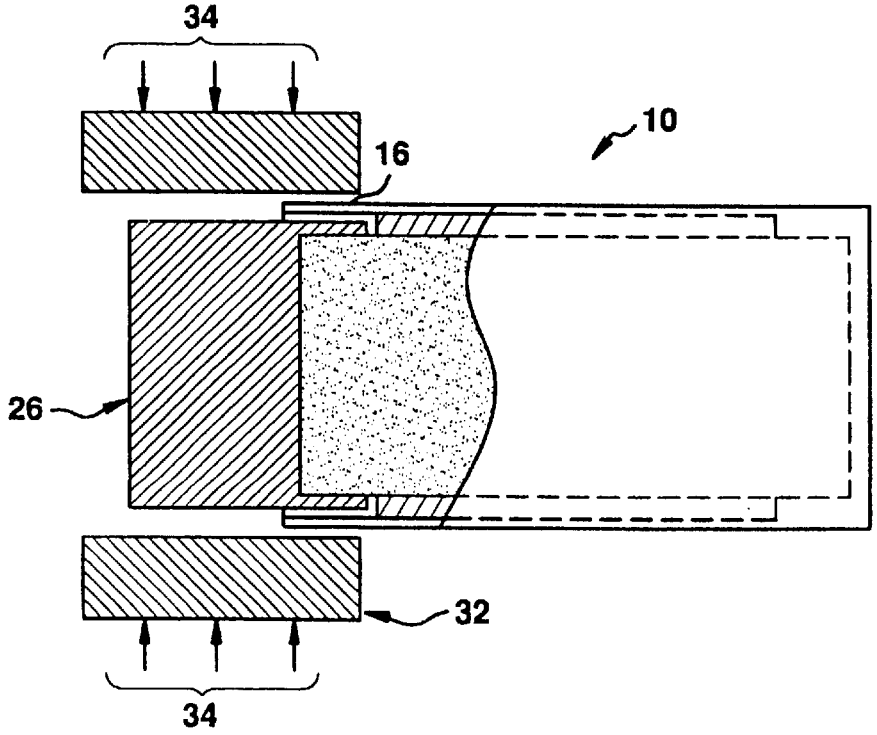

An advantage of the inventive catalytic converter is that the ends of the metal shell can be easily resized in the manner which follows. Referring now to FIGS. 3A and 3B illustrated therein are two embodiments of resizing the so-formed catalytic converters 10.

For this method of sizing to be effective the so-formed catalytic converter 10 possesses a metal shell 16 comprising a wider enclosing portion 18 which extends beyond the end of the mat material 14. Following the aforementioned compressive closing and securing steps earlier described the method, simply stated, involves inserting a resizing means, a resizing plug 26 in this embodiment, having a predetermined diameter into metal shell portion which extends beyond the mat material 14 and compressively resizing the metal shell which extends beyond the mat material.

In the FIG. 3A embodiment the compressive resizing involves the use of an external resizing ring 28 which encircles the end of metal shell 16 and which exhibits an decreasing inside diameter. The external resizing ring 28 is slid in a direction parallel to the catalytic converter's 10 length, as indicated by the arrows designated 30. Upon sliding, external sizing ring 28 compresses the metal shell into contact with resizing plug 26; the plug and ring configured to compress to the metal shell to the predetermined desired diameter for insertion into the aforementioned hot gas chamber. After compressive resizing the resizing plug is removed.

In the FIG. 3B embodiment the compressive resizing involves the use of resizing jaws 32 which compress the end of the metal shell 16, in the direction of the arrows 34, into contact with the resizing plug 26; again the plug and the jaws are configured to compress the metal shell to the predetermined diameter. As before the resizing plug is removed after compressive resizing.

Figure 4A:
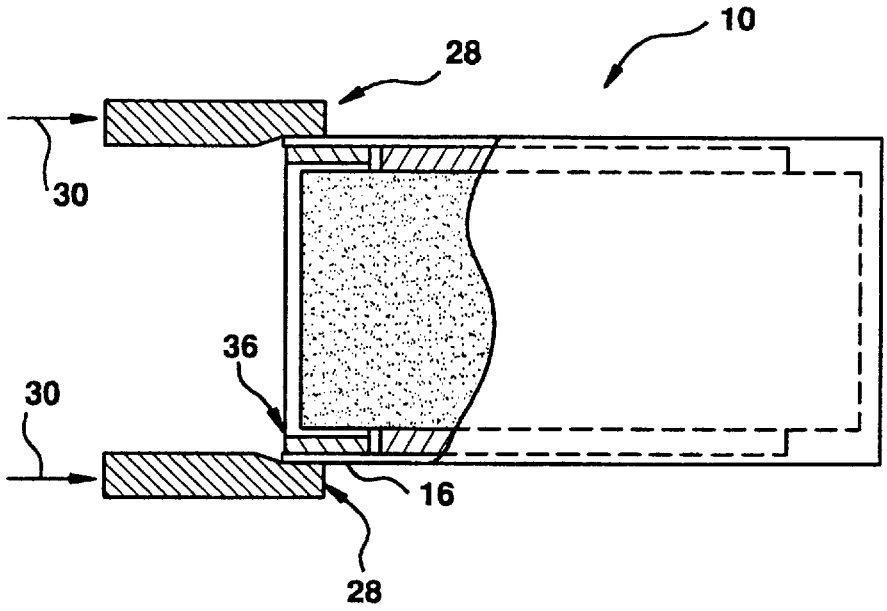
FIGS. 4A and 4B are side cross-sectional views of another embodiment of resizing the catalytic converter, in accordance with the present invention.
Figure 4B:
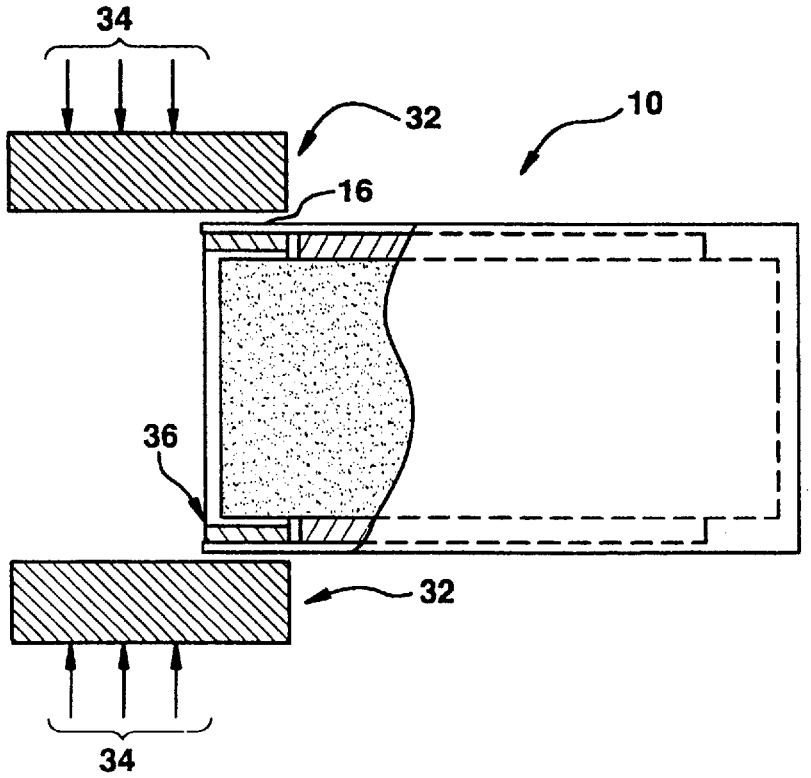

An alternative method of resizing the converter ends is illustrated in FIGS. 4A and 4B. Simply stated, this embodiment involves inserting an alternative resizing means, specifically, the use of a resizing insert ring 36 in place of the resizing plug 26. The compressive closing is done in the same manner as before using either the external resizing ring 28 or the resizing jaws 32; hence like parts for FIGS. 4A and 4B are identified with the same reference numerals as in FIGS. 3A and 3B. Unlike the resizing plug 26 in the previous embodiments the resizing insert ring 36 is not removed after compression for are explained below.

In another embodiment, the resizing insert ring can include an extending portion which extends beyond the metal shell, for example, a cone-shaped extension. After compression, this insert ring with the cone-shaped extension, remains inserted in the catalytic converter can be attached to, for example, an exhaust pipe.

Figure 5B:
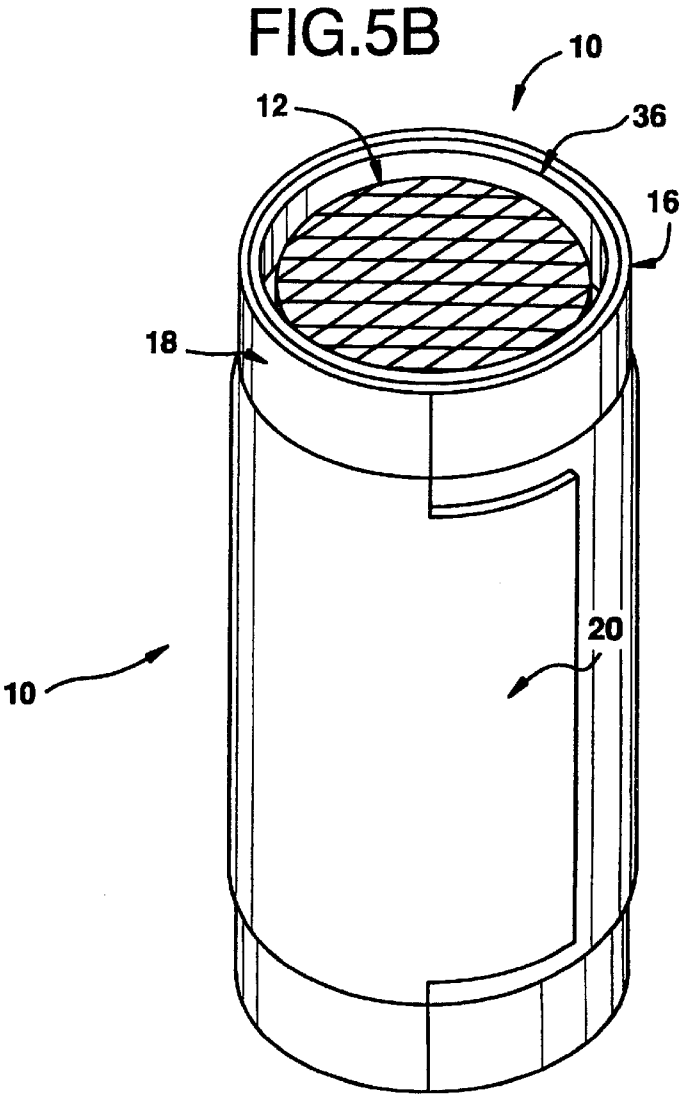
FIGS. 5A and 5B are perspective views of alternative embodiments of the inventive catalytic converter apparatus, unclosed and closed, respectively, in accordance with present invention
Figure 5A:
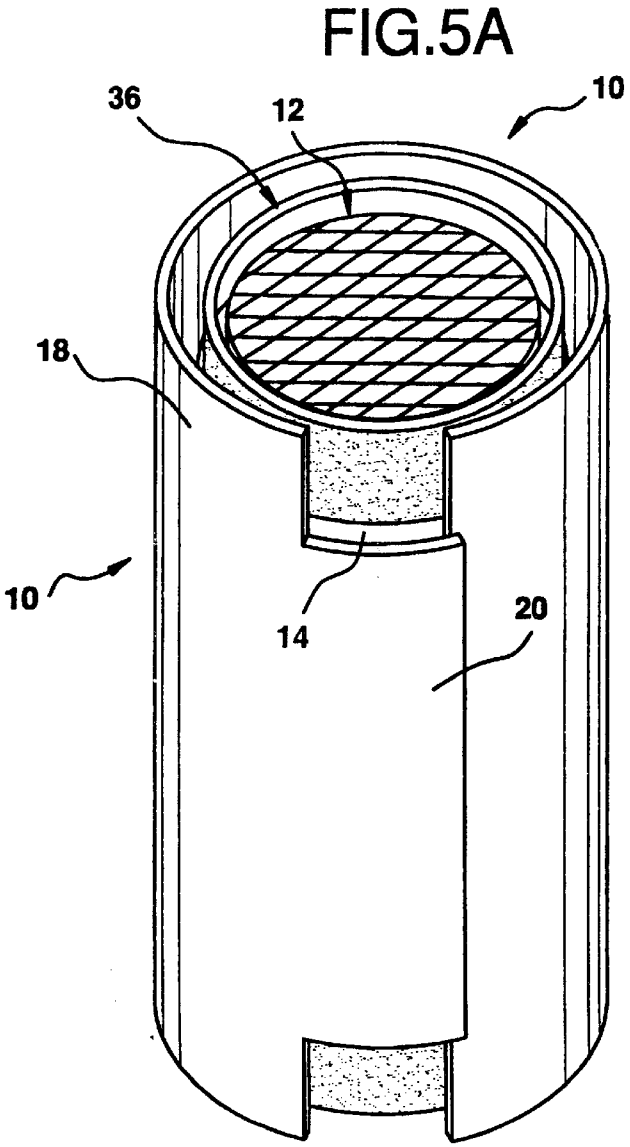

Referring now to FIGS. 5A and 5B illustrated therein is another embodiment of a catalytic converter according to the invention; FIG. 5A uncompressed and FIG. 5B compressed. The catalytic converter 10 is similar to that converter illustrated in FIGS. 1 and 1A, except that the converter includes the resizing insert ring 36, illustrated in FIGS. 4A and 4B which remains in the so-formed catalytic converter 10 configuration and functions as a mat protecting ring 36 which protects the mat material from exposure to hot exhaust gases. Hence, like parts for FIGS. 5 and 5A are identified with the same reference numerals used for the components of the catalytic converter detailed in FIGS. 1A and 1B.

Ceramic honeycomb substrate suitable for use in the present invention may be formed from any ceramic material conventionally used for this purpose such as is disclosed, for example in U.S. Pat. No. 3,885,977 or U.S. Pat. No. Reissue No. 27,747. The honeycomb substrate is typically treated with a catalyst containing washcoat prior to installation in the metal shell. The washcoat typically contains a refractory oxide, such as alumina or magnesia, and one or more catalyst element, such as scanadium, yttrium etc. Preferably, an extruded cordierite ceramic substrate having a high mechanical integrity, low resistance to gas flow and a high geometric surface area is utilized as the substrate. One important parameter for the ceramic substrate is its mechanical integrity, in particular its radial strength. Typical cordierite honeycomb substrates are capable of easily withstanding more than 4826.5 kPa (700 psi) of radial pressure before noticeable damage to the honeycomb occurs.

Mat material suitable for use in the present invention comprise a formed ceramic fiber material, a simple non-expanding ceramic material. Acceptable non-expanding ceramic fiber material include ceramic materials such as those sold under the trademarks "NEXTEL" and SAFFLL" by the "3M" Company, Minneapolis, or those sold under the trademarks "CC-MAX" and "FIBERMAX" by the Unifrax Co., Niagara Falls, N.Y.

Suitable materials for the metal shell 16 comprise any material which is capable of resisting under-car salt, /temperature and corrosion; ferritic stainless steels including grades SS-409, SS-439, and more recently SS-441 are however, generally preferred. The choice of material depends on the type of gas, the maximum temperature and the like.

It is to be understood that the present invention is not limited to the embodiments described above, and that various changes and modifications may be effected therein by one skilled in the art without departing from the intended scope or spirit of the invention.

We claim:

1. A catalytic converter for purifying exhaust gases from an internal combustion engine, comprising:

a monolithic ceramic substrate having a peripheral surface;

a non-intumescent supporting mat encircling the peripheral surface;

a metal shell enclosing and exerting a compressive force on the ceramic substrate and supporting mat, the metal shell having a narrower extending attachment portion and a wider enclosing portion, the narrower extending portion overlapping and being attached to the outer surface of the wider enclosing portion and the wider enclosing portion having metal shell end portions extending beyond the ends of the supporting mat; and resizing insert rings disposed within each of the metal shell end portions;

the metal shell end portions being resized such that they are compressed into contact with the resizing insert rings, and the resized metal shell end portions being smaller in outer diameter than the outer diameter of the metal shell portions enclosing and exerting a compressive force on the ceramic substrate and supporting mat.

2. A catalytic converter in accordance with claim 1 wherein the wider enclosing portion of the metal shell exhibits a width that is equal to or greater than the length of the substrate.

3. A catalytic converter in accordance with claim 1 wherein the ceramic substrate includes end portions not covered by the supporting mat.

* * * * *